US005094737A

United States Patent [19]

Bearden, Jr. et al.

[11] Patent Number: 5,094,737

[45] Date of Patent: Mar. 10, 1992

[54] INTEGRATED COKING-GASIFICATION PROCESS WITH MITIGATION OF BOGGING AND SLAGGING

[75] Inventors: Roby Bearden, Jr., Baton Rouge, La.; Tan-Jen Chen, Clearwater, Canada; William N. Olmstead, Murray Hill, N.J.

[73] Assignee: Exxon Research & Engineering Company, Florham Park, N.J.

[21] Appl. No.: 591,335

[22] Filed: Oct. 1, 1990

[51] Int. Cl.[5] ..... C10G 9/28

[52] U.S. Cl. ..... 208/127; 208/126; 208/147; 208/157

[58] Field of Search ..... 208/48 AA, 126, 127, 208/147, 157, 160

[56] References Cited

U.S. PATENT DOCUMENTS 2,953,518 9/1960 McKinley et al. ..... 208/127

4,707,461 11/1987 Mitchell et al. ..... 208/120

*Primary Examiner*—Curtis R. Davis

*Assistant Examiner*—William C. Diemler

*Attorney, Agent, or Firm*—Henry E. Naylor

[57] ABSTRACT

A fluid coking-gasification process for converting heavy hydrocarbonaceous chargestocks to lower boiling products in which calcium silicate is used to mitigate bogging, slagging, or both. The calcium silicate can be added directly to the heavy hydrocarbonaceous chargestock to mitigate both bogging and slagging or it can be added directly into the gasifier to mitigate slagging.

11 Claims, 2 Drawing Sheets

GASIFIER
3
HEATER
2
REACTOR
1
STEAM
STEAM
$O_2$
10
12
14
16
18
20
22
24
25
26
28
30
32
32
34
36
38
39
40
42
44
46
48
50
52
54
56
58
62
64
66

INTEGRATED COKING-GASIFICATION PROCESS WITH MITIGATION OF BOGGING AND SLAGGING

FIELD OF THE INVENTION

The present invention relates to an improved integrated fluid coking-gasification process wherein porous calcium silicate is used to mitigate bogging in the coker and/or slagging in the gasifier.

BACKGROUND OF THE INVENTION

Much work has been done over the years to convert heavy hydrocarbonaceous materials to more valuable lighter boiling products. One such process is an integrated fluid coking-gasification process in which a heavy hydrocarbonaceous chargestock is fed to a coking zone comprised of a fluidized bed of hot solid particles, usually coke particles, sometimes referred to as seed coke. The heavy hydrocarbonaceous material is reacted in the coking zone resulting in conversion products which include a vapor fraction and coke. The coke is deposited on the surface of the seed particles. A portion of the coked-seed particles is sent to a heater which is maintained at a temperature higher than that of the coking zone where some of the coke is burned off. Hot seed particles from the heater are returned to the coking zone as regenerated seed material and serves as the primary heat source for the coking zone. Coke from the heating zone is circulated to and from a gasification zone which is maintained at a temperature greater than the heating zone. In the gasifier, substantially all of the coke which was laid-down on the seed material in the coking zone, and which was not already burned-off in the heating zone, is burned, or gasified, off. Some U.S. Patents which teach an integrated fluid coking-gasification process are U.S. Pat. Nos. 3,726,791; 4,203,759; 4,213,848; and 4,269,696; all of which are incorporated herein by reference.

Fluid coking liquid yields are maximized and product quality is improved as the reactor temperature is lowered. Further, benefits can also be captured by increasing the reactor throughput at constant temperature. However, the degree to which lower temperature and/or increased throughput can be realized is presently limited by loss of fluidization (bogging) in the fluid coker vessel. Physically, as the temperature is lowered, or throughput increased, the concentration of tacky coke precursors increases to the point where the dispersing capacity of the circulating fluid coke is exceeded. At this point, bridging of coke particles occurs and the bed begins to bog.

Another problem which can be encountered is slagging in the gasifier of an integrated fluid coking-gasification commercial unit. Slagging is a complex phenomenon which is influenced by many factors and which can be a cause of operability problems. For example, the formation of significant amounts of slag can cause blockage of the grid assembly in the gasifier. The grid assembly is comprised of inlet pipes for the introduction of steam and the oxygen-containing gas, and it is located at the bottom of the gasifer. Blockage of this grid assembly will increase the pressure and have an adverse effect on the flow distribution in the bed. If the blockage becomes excessive, design gasification rates may not be achievable and/or run lengths may have to be reduced. Slags can also corrode the cap materials of the grid assembly and form even larger slag accumulations. It is believed that the presence and build-up of high melting vanadium salts in the gasifier are the chief cause of slagging. Consequently, there exists a need in the art for ways to mitigate both bogging and slagging problems in fluid coking.

SUMMARY OF THE INVENTION

In accordance with the present invention, there is provided an improved integrated fluid coking-gasification process for converting heavy hydrocarbonaceous materials to lower boiling products. The process comprises:

(a) introducing a heavy hydrocarbonaceous chargestock into a coking zone comprised of a bed of fluidized solids maintained at fluid coking conditions, including a temperature from about 850° to 1200° F. and a total pressure of up to about 150 psig, to produce a vapor phase product including normally liquid hydrocarbons, and coke, the coke depositing on the fluidized solids;

(b) introducing a portion of said solids, with coke deposited thereon into a heating zone comprised of a fluidized bed of solid particles and operated at a temperature greater than said coking zone; and (c) recycling a portion of said heated solids from said heating zone to said coking zone;

(d) introducing a second portion of said heated solids from the heating zone to a gasification zone comprised of a fluidized bed of solid particles and maintained at a temperature greater than said heating zone; and (e) reacting said second portion of heated solids in said gasification zone with steam and an oxygen-containing gas;

wherein an effective amount of calcium silicate is used to prevent bogging and/or slagging by a method selected from: (i) mixing it with the heavy hydrocarbonaceous chargestock prior to introduction into the coker; (ii) adding it at the bottom of the gasifier of the gasification zone; or (iii) mixing it with the portion of hot solids passing from the heating zone to the gasification zone, or with a portion of hot solids passing from the heating zone to the coking zone; or (iv) one or more of the above.

In a preferred embodiment of the present invention about 0.1 to 20 wt. % of calcium is used based on the weight of the coke, and is mixed with the heavy hydrocarbonaceous chargestock prior to introduction into the coking zone.

In another preferred embodiment of the present invention, the calcium silicate is added at the bottom of the gasifier.

DETAILED DESCRIPTION OF THE INVENTION

Any heavy hydrocarbonaceous material typically used in a coking process can be used herein. Generally, the heavy hydrocarbonaceous material will have a Conradson carbon residue of about 5 to 40 wt. % and be comprised of moieties, the majority of which boil above about 975° F. Suitable hydrocarbonaceous materials include heavy and reduced petroleum crudes, petroleum atmospheric distillation bottoms, petroleum vacuum distillation bottoms, pitch, asphalt, bitumen, liquid products derived from coal liquefaction processes, including coal liquefaction bottoms, and mixtures thereof.

A typical heavy hydrocarbonaceous chargestock suitable for the practice of the present invention will have a composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |
| Boiling Point | 340° C.+ to 650° C.+ |
| Specific Gravity | −10 to 35° API |

Figure 1:
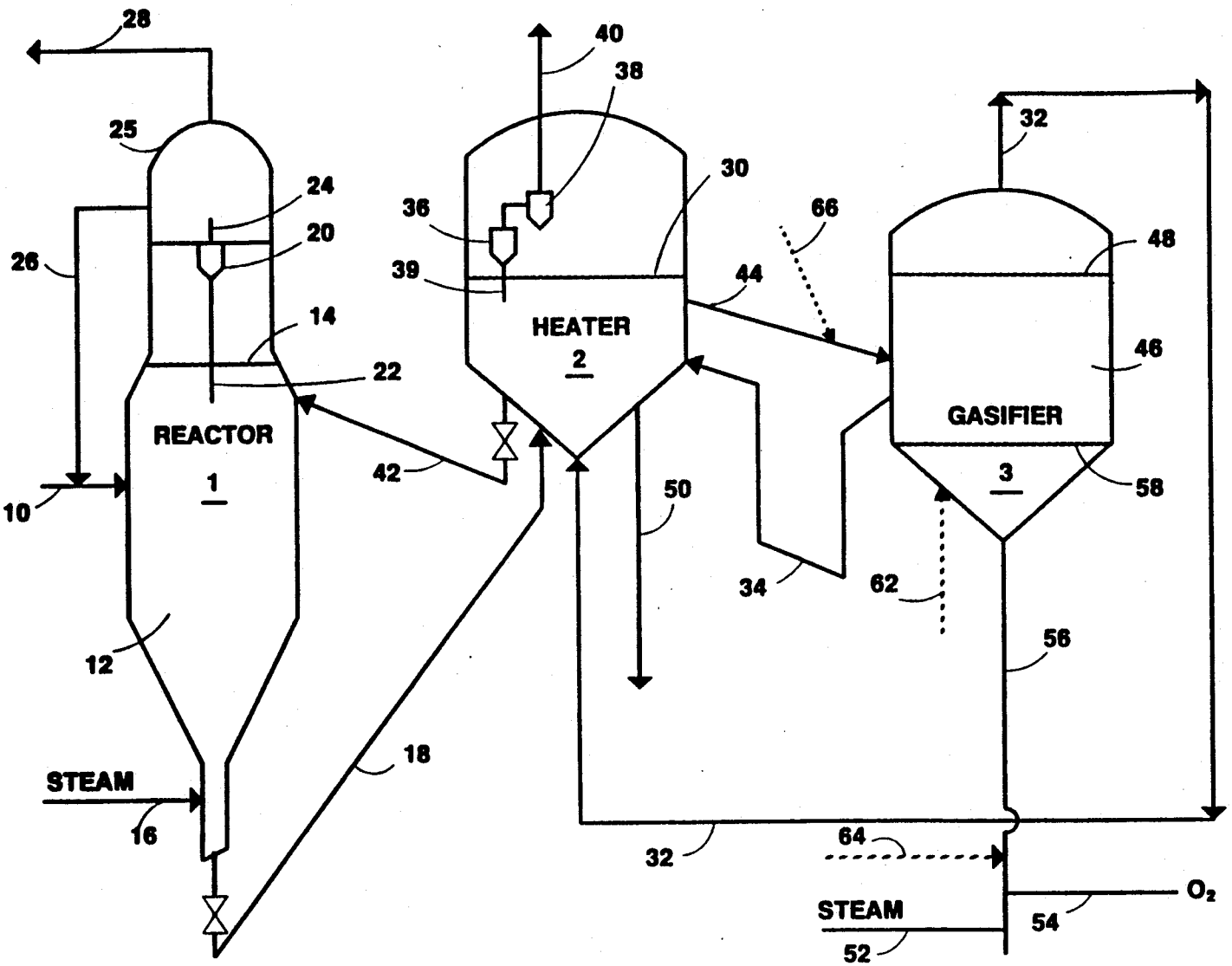
FIG. 1 hereof is a schematic flow plan of one embodiment of the present invention for practicing an integrated coking/gasification process showing points where the calcium silicate can be introduced into the process unit.

With reference now to FIG. 1 hereof, which shows an integrated fluid coking/gasification unit where most of the coke is gasified with a mixture of steam and air. The reaction vessel is similar for a fluid coking process than it is for an integrated fluid coking/gasification process. In the figure, a heavy hydrocarbonaceous chargestock is mixed with calcium silicate and passed by line 10 into coking zone 12 in which is maintained a fluidized bed of solids having an upper level indicated at 14. Although it is preferred that the solids, or seed material, be coke particles, they may also be other refractory materials such as those selected from the group consisting of silica, alumina, zirconia, magnesia, alumdum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns.

A fluidizing gas e.g. steam, is admitted at the base of coker reactor 1, through line 16, in an amount sufficient to obtained superficial fluidizing velocity in the range of about 0.5 to 5 ft/sec. Coke at a temperature above the coking temperature, for example, at a temperature from about 100° to 400° F. in excess of the actual operating temperature of the coking zone is admitted to reactor 1 by line 42 in an amount sufficient to maintain the coking temperature in the range of about 850° to 1400° F. The pressure in the coking zone is maintained in the range of about 0 to 150 psig, preferably in the range of about 5 to 45 psig. The lower portion of the coking reactor serves as a stripping zone to remove occluded hydrocarbons from the coke. A stream of coke is withdrawn from the stripping zone by line 18 and circulated to heater 2. Conversion products are passed through cyclone 20 to remove entrained solids which returned to coking zone through dipleg 22. The vapors leave the cyclone through line 24, and pass into a scrubber 25 mounted on the coking reactor. If desired, a stream of heavy materials condensed in the scrubber may be recycled to the coking reactor via line 26. The coker conversion products are removed from the scrubber 25 via line 28 for fractionation in a conventional manner. In heater 2, stripped coke from coking reactor 1 (cold coke) is introduced by line 18 to a fluid bed of hot coke having an upper level indicated at 30. The bed is partially heated by passing a fuel gas into the heater by line 32. Supplementary heat is supplied to the heater by coke circulating from gasifier 3 through line 34. The gaseous effluent of the heater, including entrained solids, passes through a cyclone which may be a first cyclone 36 and a second cyclone 38 wherein the separation of the larger entrained solids occur. The separated larger solids are returned to the heater bed via the respective cyclone diplegs 39. The heated gaseous effluent which contains entrained solids is removed from heater 2 via line 40.

A portion of hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke having a level indicated at 48. If desired, a purged stream of coke may be removed from heater 2 by line 50.

The gasification zone is maintained at a temperature ranging from about 1600° to 2000° F. at a pressure ranging from about 0 to 150 psig, preferably at a pressure ranging from about 25 to about 45 psig. Steam by line 52, and a molecular oxygen-containing gas, such as air, commercial oxygen, or air enriched with oxygen by line 54 pass via line 56 into gasifier 3. The reaction of the coke particles in the gasification zone with the steam and the oxygen-containing gas produces a hydrogen and carbon monoxide-containing fuel gas. The gasified product gas, which may further contain some entrained solids, is removed overhead from gasifier 3 by line 32 and introduced into heater 2 to provide a portion of the required heat as previously described.

There is a grid assembly 58 at the bottom of the gasifier which is comprised of inlet pipes for the introduction of steam and the oxygen-containing gas. During normal operation of the gasifier, slag deposits on the grid assembly, which corrodes the grid cap materials and in turn forms larger slag accumulations. The plugged grid caps reduce the available open area and consequently increase grid pressure drop and affects the flow distribution in the bed. If the amount of grid cap plugging, becomes excessive, design gasification rates may not be achievable and/or run lengths may have to be reduced. The vanadium in the coke is considered the contaminant most likely to promote slag formation. For example, vanadium pentoxide has a low melting point relative to the operating temperature of commercial gasifiers. Sodium is another likely contaminant; however, its concentration in gasifier coke is generally low compared to vanadium.

Calcium silicate, which is suitable for mitigating both bogging and slagging can be introduced into the fluid coking process unit is several ways. For example, when it is used to mitigate bogging, it is mixed with the heavy hydrocarbonaceous chargestock via line 60 and the mixture charge into the coker reactor. When introduced this way, it will also be carried through the process unit and introduced into the gasifier where it will have a tendency to mitigate slagging. If the process is operated such that bogging is not a problem, then the calcium silicate can be used to mitigate slagging only by introducing it into the gasifier by any of several ways. For example, it can be added as fines and blown in with air through a separate line 62 at the bottom of the gasifier. It can also be introduced via line 64 at the bottom of the gasifier with the steam and oxygen-containing gas via line 56. It can also be introduced via line 66 into line 44 where it is mixed with the portion of heater coke passing to the gasifier. Preferred is when it is introduced at the bottom of the gasifier. This technique has the advantage in that the calcium silicate, even when added intermittently, provides some scouring action which may physically reduce slag formation on the gasifier grid caps.

The amount of calcium silicate used in the practice of the present invention will depend on whether it is used only to mitigate slagging or used to mitigate both slagging and bogging. For mitigation of slagging, the amount of calcium silicate used is such that the molar ratio of calcium of the calcium silicate to vanadium in the feed will fall in the range of about 0.5 to 1, up to about 10 to 1, preferably from about 2 to 1 to 5 to 1. For mitigation of bogging, the amount of calcium silicate added may exceed the amount needed to control slagging alone and will depend on the temperature used in the fluid coking zone and on characteristics of residuum feed to the coker, particularly the conradson carbon content of the residuum. In general, the amount of calcium silicate needed to control bogging will range from about 0.1 to 5.0 wt. % on residuum, preferably from about 0.2 to 2.0 wt. %.

As to properties of the calcium silicate, finely divided particles are preferred, i.e., less than about 50 microns and untrafine particle, synthetic calcium silicate is particularly preferred. The synthetic variety, prepared by the hydrothermal fusion of diatomaceous silica and lime, is marketed by Manville Corporation under the tradename of Microcel. Such materials exhibit median particle size in the range of 10 to 20 microns, surface areas from 90 to 175 $m^2/g$, and absorption capacities of up to 490 wt. % (oil absorption).

Having thus described the present invention, and a preferred and most preferred embodiment thereof, it is believed that the same will become even more apparent by reference to the following examples. It will be appreciated, however, that the examples are presented for illustrative purposes and should not be construed as limiting the invention.

EXAMPLE 1

A static bed test was performed by placing 4.29 g. of synthetic calcium silicate (Micro-cel E, available from Manville Corp.) and 30 g. of heater coke from a commercial integrated fluid coker/gasifier unit in a Coors (alumina) evaporating dish. The dish was then placed in a 12 inch Lindberg muffle furnace. In another dish, 30 g. of heater coke was charged without the addition of calcium silicate for comparison purposes.

The heater coke had the following properties:

| | |
|---|---|
| Surface Area, $m^2/g$ | 9.1 |
| Pore Volume, cc/g | 0.009 |
| Density - App. Bulk, g/cc | 0.82 |
| Attrition, Davison Index | 1 |
| Ash, wt. % | 3.16 |
| Sulfur, wt. % | 2.25 |
| V, wt. % | 1.49 |
| Na, wppm | 637 |
| Ni, wppm | 2988 |

The calcium silicate had the following properties:

| | |
|---|---|
| Surface Area, $m^2/g$ | 95 |
| Specific Gravity | 2.45 |
| Median Particle Size, microns | 11.50 |
| Oil Absorption, wt. % | 490 |

The samples were purged with air and the furnace was heated at a rate of 9° F./min. to a final temperature of 1750° F., which was held there for four hours to ensure complete combustion-gasification. Two types of materials were left in the dishes, a hard slag material and a soft non-slag material. The amounts of each are shown in Table I below. The soft non-slag material was powdery and was easily poured from the dish. The hard slag material strongly adhered to the dish. This hard material is representative of the slag material in commercial gasifiers.

TABLE I

| Sample | Hard Deposit g. | Soft Deposit g. |
|---|---|---|
| 30 g. coke only | 0.54 | 0.55 |
| 30 g. coke/4.29 g. $CaSiO_3$ | 0.03 | 6.02 |

The above table illustrates the effectiveness of calcium silicate in controlling slag formation.

EXAMPLE 2

Figure 2:
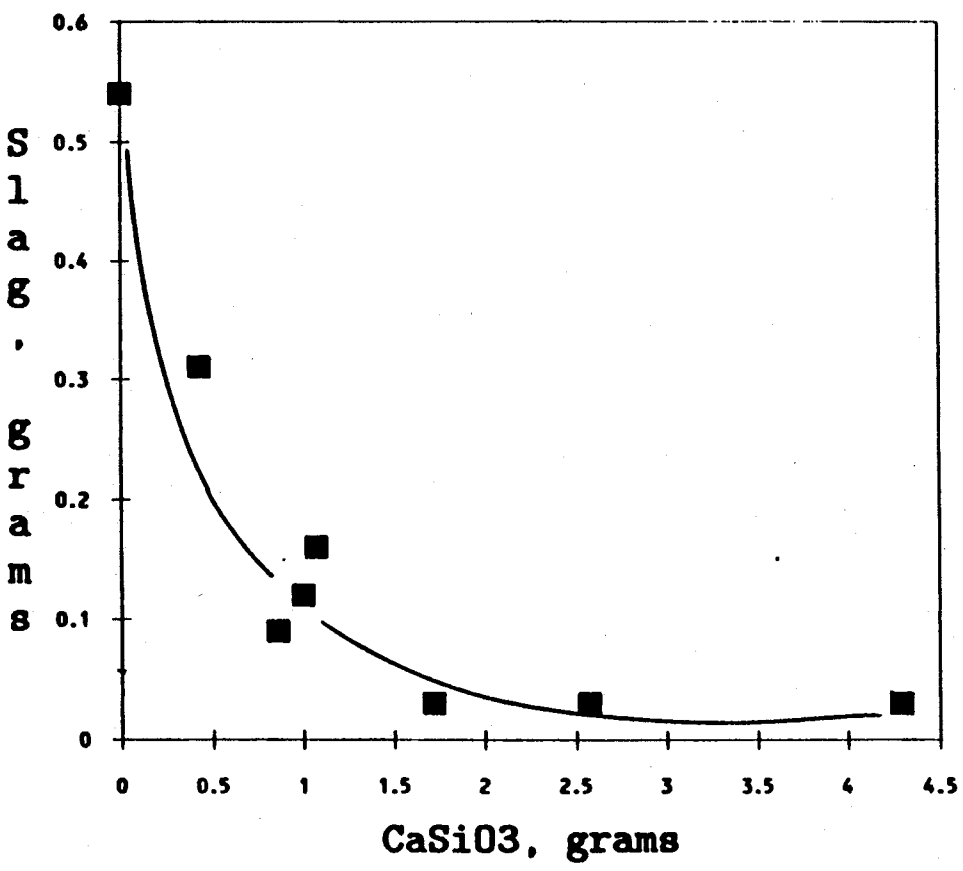
FIG. 2 hereof is a graphical representation of slag reduction versus calcium silicate concentration for Example 2 hereof.

This example was conducted to show the effectiveness of various concentrations of calcium silicate for controlling slagging. The procedure of Example 1 above was followed for various amounts of calcium silicate. The results of hard slag material formation versus amounts of calcium silicate were plotted and are presented in FIG. 2 hereof.

What is claimed is:

1. In a fluid coking-gasification process for converting heavy hydrocarbonaceous materials to lower boiling products, which process comprises:

(a) introducing a heavy hydrocarbonaceous chargestock into a coking zone comprised of a bed of fluidized solids maintained at fluid coking conditions, including a temperature from about 850° to 1200° F. and a total pressure of up to about 150 psig, to produce a vapor phase product including normally liquid hydrocarbons, and coke, the coke depositing on the fluidized solids;

(b) introducing a portion of said solids with coke deposited thereon into a heating zone comprised of a fluidized bed of solid particles and operated at a temperature greater than said coking zone; and (c) recycling a portion of said heated solids from said heating zone to said coking zone;

(d) introducing a second portion of said heated solids from the heating zone to a gasification zone comprised of a fluidized bed of solid particles and maintained at a temperature greater than the heating zone; and (e) reacting said second portion of heated solids in said gasification zone with steam and an oxygen-containing gas;

the improvement which comprises using an effective amount of calcium silicate to prevent bogging and/or slagging, wherein the calcium silicate is introduced into the process by one or more procedures selected from: (i) mixing it with the heavy hydrocarbonaceous chargestock prior to introduction into the coking zone; (ii) adding it directly into the gasification zone; and (iii) mixing it with the portion of heated solids passing from the heating zone to the gasification zone.

2. The process of claim 1 wherein calcium silicate is added to prevent slagging and the amount added, based on the weight ratio of calcium silicate to vanadium in the chargestock, ranges from about 0.5 to 1 to about 10 to 1.

3. The process of claim 2 wherein the weight ratio of calcium silicate to vanadium is from about 2 to 1 to 5 to 1.

4. The process of claim 2 wherein the calcium silicate is added directly into the gasification zone.

5. The process of claim 2 wherein the calcium silicate is added by mixing it with the portion of heated solids passing from the heating zone to the gasification zone.

6. The process of claim 1 wherein the calcium silicate is added to mitigate bogging and is added in an amount ranging from about 0.1 to 5 wt. % on feed.

7. The process of claim 6 wherein the amount of calcium silicate added is about 0.2 to 2 wt. % on feed.

8. The process of claim 1 wherein the heating zone is operated at a temperature which is about 100° to 400° F. greater than that of the coking zone.

9. The process of claim 8 wherein the heating zone is operated at a temperature which is about 150° to 350° F. greater than the coking zone.

10. The process of claim 3 wherein the heating zone is operated at a temperature which is about 100° to 400° F. greater than that of the coking zone.

11. The process of claim 5 wherein the heating zone is operated at a temperature which is about 100° to 400° F. greater than that of the coking zone and the gasification zone is operated at a temperature from about 1600° to 2000° F.

* * * * *